US011019965B2

(12) United States Patent
Beck et al.

(10) Patent No.: US 11,019,965 B2
(45) Date of Patent: Jun. 1, 2021

(54) BATHTUB DRAIN FLANGE ASSEMBLY

(71) Applicant: PF Waterworks LP, Houston, TX (US)

(72) Inventors: Harold Kent Beck, Copper Canyon, TX (US); Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 26 days.

(21) Appl. No.: 16/194,344

(22) Filed: Nov. 18, 2018

(65) Prior Publication Data

US 2019/0167043 A1 Jun. 6, 2019

Related U.S. Application Data

(60) Provisional application No. 62/593,893, filed on Dec. 2, 2017.

(51) Int. Cl.

| | |
|---|---|
| ***A47K 1/14*** | (2006.01) |
| ***E03C 1/22*** | (2006.01) |
| ***E03C 1/262*** | (2006.01) |
| *E03C 1/24* | (2006.01) |

(52) U.S. Cl.

CPC ..... *A47K 1/14* (2013.01); *E03C 1/22* (2013.01); *E03C 1/262* (2013.01); *E03C 1/24* (2013.01)

(58) Field of Classification Search

CPC .. A47K 1/14; E03C 1/22; E03C 1/262; E03C 1/24

USPC ..... 4/286–290, 295

See application file for complete search history.

(56) References Cited

U.S. PATENT DOCUMENTS

| | | | | |
|---|---|---|---|---|
| 4,369,531 | A * | 1/1983 | Swanson | E03C 1/262 4/286 |
| 5,418,983 | A * | 5/1995 | Garguillo | E03C 1/22 4/286 |
| 6,067,669 | A * | 5/2000 | Peterson | E03C 1/262 4/287 |
| 6,219,861 | B1 * | 4/2001 | Chen | A47K 1/14 251/323 |
| 6,490,739 | B1 * | 12/2002 | Lee | A47K 1/14 4/293 |
| 2014/0101834 | A1 * | 4/2014 | Ball | E03C 1/22 4/286 |
| 2017/0130435 | A1 * | 5/2017 | Sebolt | E03C 1/262 |

* cited by examiner

*Primary Examiner* — Tuan N Nguyen

(74) *Attorney, Agent, or Firm* — Stephen S. Hodgson

(57) ABSTRACT

A bathtub drain flange assembly includes a tubular drain flange fitting that has a radially-extending flange on an upper end and male threads on a lower end. A support structure in the lower end of the drain flange has an oversized or larger-than-normal opening, which is usually threaded. A reducing bushing is received in the opening and has a threaded bore that is one of a number of different sizes for receiving a plumbing device such as a drain stopper, a strainer or a drain cover. A bathtub drain flange kit includes a drain flange with a larger-than-maximum-standard size for an opening in the drain flange and two or more reducing bushings that fit properly in the opening and become fastened to the drain flange, where each of the reducing bushings provides a threaded bore that is a standard size for receiving a plumbing device.

27 Claims, 3 Drawing Sheets

FIG.3
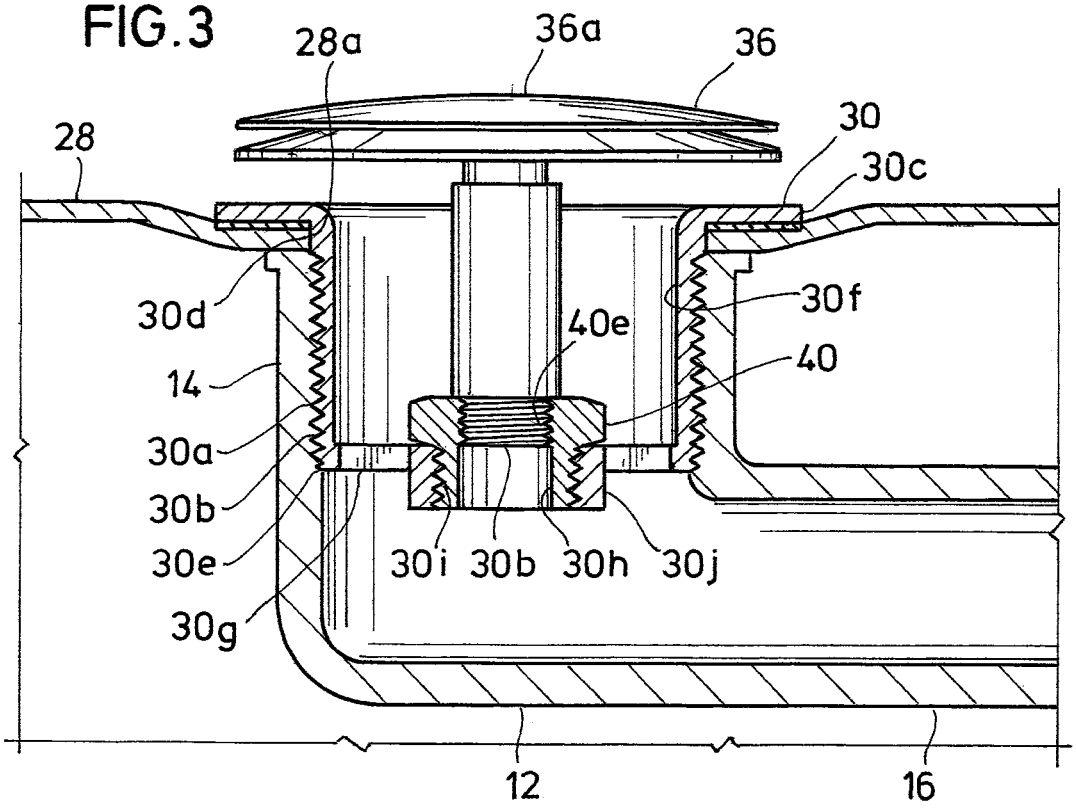
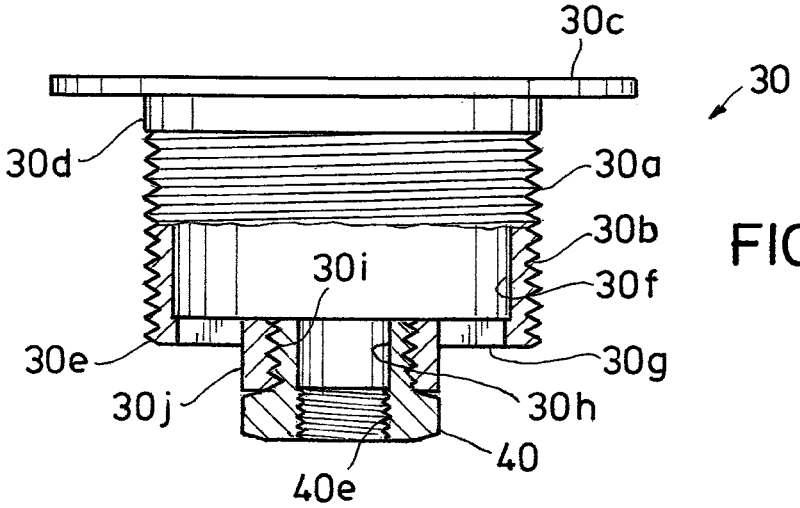
FIG.4
FIG.5
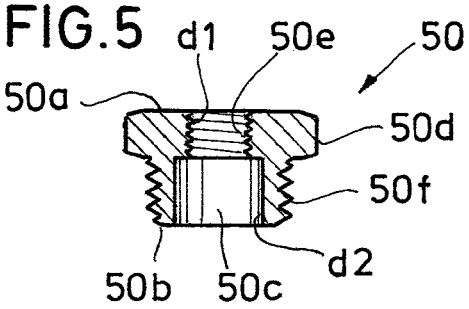
FIG.6
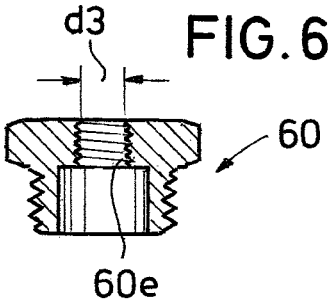

FIG.7
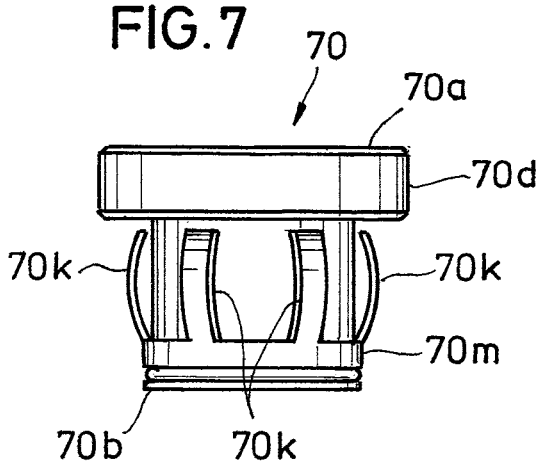
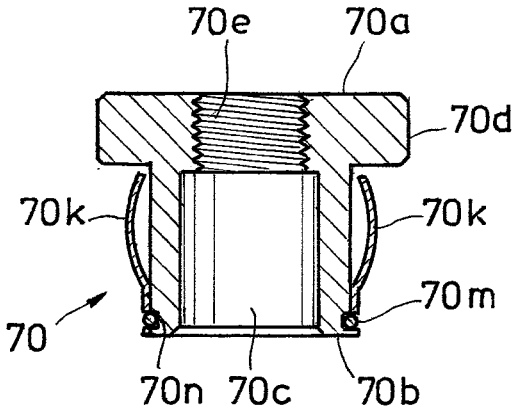
FIG.9
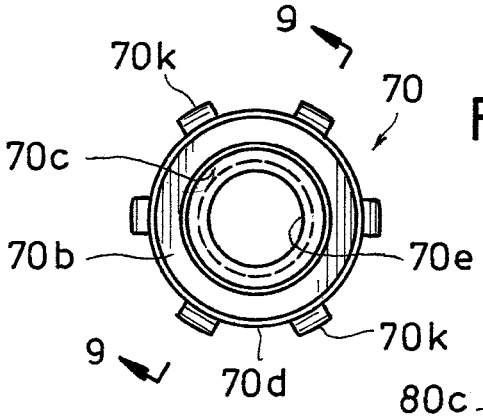
FIG.8
FIG.10
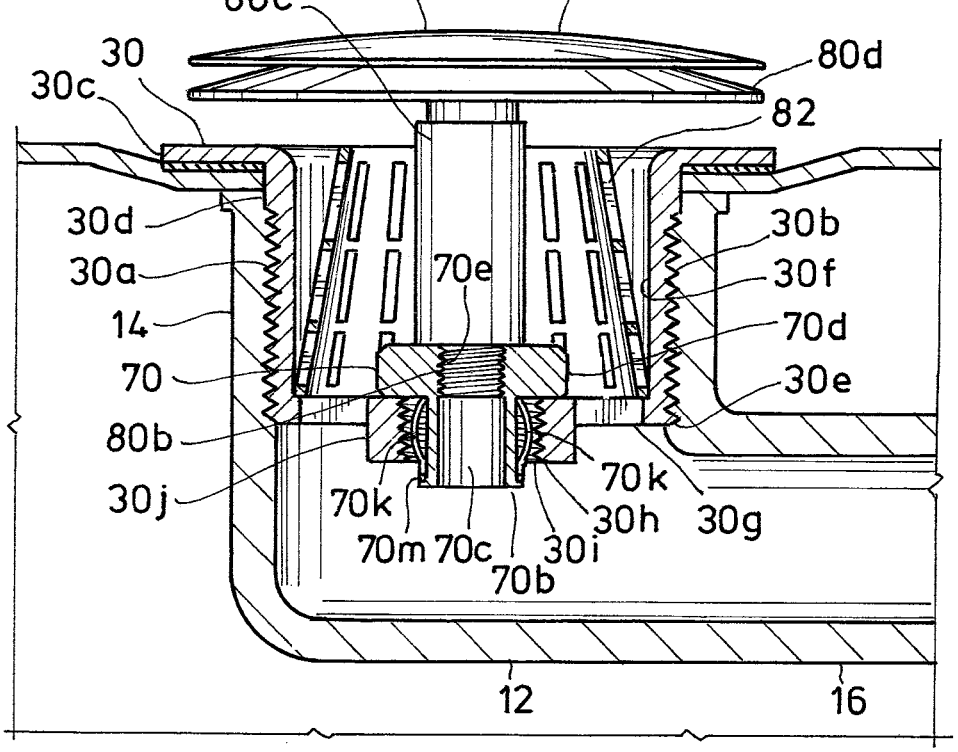

BATHTUB DRAIN FLANGE ASSEMBLY

CROSS REFERENCE TO RELATED APPLICATIONS

This application claims priority to and the benefit of U.S. Provisional Patent Application Ser. No. 62/593,893 filed Dec. 2, 2017, which is incorporated by reference. This application is related to U.S. patent application Ser. No. 15/584,032 filed May 2, 2017, and published under Pub. No. 2017/0314245 A1 and Ser. No. 15/913,452 filed Mar. 6, 2018, and published under Pub. No. 2018/0263426 A1, each of which is incorporated by reference.

BACKGROUND OF THE INVENTION

1. Field of the Invention

This present invention pertains to a bathtub drain system and more particularly to a drain flange, which is a short piece of pipe that extends through a drain opening and has a flange that is visible in the bottom of a bathtub.

2. Description of the Related Art

Water drains from a bathtub through a bathtub drain system or assembly. The bathtub has a drain opening. The drain system includes an L-shaped drain pipe, which is sometimes referred to as a bathtub drain shoe and which includes a 90-degree elbow that has female threads on one end and a length of drain pipe on the other end. The female threads of the elbow is placed below the drain opening. A short piece of pipe that has male threads on a lower end and a radially-extending flange on the upper end is referred to as a drain body or a drain basket or a drain flange. The lower end of the drain flange is passed through the drain opening in the bathtub, and the flange end remains above and surrounds the drain opening. Plumber's putty can be used around the underside of the flange to provide a seal against the bathtub. The male threads are screwed into the female threads of the elbow to provide a drainage flow path. A washer or a gasket may be used around the male threads adjacent to the underside of the bathtub. The elbow may have a radially-extending flange that presses against the washer or gasket or underside of the bathtub as the male threads of the drain body are screwed into the female threads of the elbow.

The lower end of the drain flange typically has a support structure inside that includes a threaded opening. The bathtub drain system generally includes a drain stopper or a strainer or a drain cover that is screwed into the threaded opening in the support structure inside the drain flange. The related U.S. Patent Application Pub. Nos. 2017/0314245 A1 and 2018/0263426 A1 provide examples of drain stoppers, strainers and drain covers.

Various manufacturers make and sell bathtub drain systems. There is no single standard size for the threaded opening in the support structure in the drain flange. Each manufacturer makes and sells a bathtub drain system that includes a drain flange that has a threaded opening that is one of several different sizes. A new bathtub drain system from a manufacturer may include or have available a stopper or a strainer or a cover that fits the threaded opening. However, there is often a problem with a mismatch between the size of threads on a plumbing device such as a stopper, strainer or cover and the size of the threaded opening in the support structure in the drain flange, particularly with retrofitting an older drain flange with a newer drain stopper, strainer, drain cover or the like.

SUMMARY OF THE INVENTION

The present invention solves the problem of a mismatch between the size of threads on a plumbing device and the size of the threaded opening in the support structure in the drain flange by providing a drain flange that has an oversized threaded opening in the support structure and a reducing bushing that fits properly in the oversized threaded opening and has a threaded bore that is one of the several standard sizes for bathtub plumbing devices such as drain stoppers, drain guards, drain covers and drain strainers.

A bathtub drain flange assembly is provided that includes: (1) a bathtub drain flange that comprises: (i) a tube having upper and lower ends and inner and outer surfaces; (ii) a flange extending radially outwardly from the upper end; (iii) male threads on the outer surface; and (iv) a support structure in the lower end attached to or formed integral with the inner surface, where the support structure defines an opening, which preferably has female threads; and (2) a reducing bushing received in the opening, where the reducing bushing has an inside surface and an outside surface, where the outside surface is engaged with the support structure, where the inside surface defines a longitudinal bore, and where the inside surface has female threads for receiving a plumbing device such as a drain stopper, a strainer or a drain cover. The reducing bushing can be threaded into opening in the support structure or can be engaged with the support structure by a friction fit or an interference fit for a friction-based engagement. The support structure preferably has a strengthening or reinforcement ring that increases the length of the opening, which preferably extends outside the drain flange rather than inside an inner space defined by the support structure and the inner surface of the tube. A bathtub drain flange kit is also provided that includes a drain flange with an oversized opening, which may or may not be threaded, and two or more reducing bushings, where each reducing bushing provides one of the several different standard sizes for holes that have female threads for receiving plumbing devices that have male threads, which are typically received in a bathtub drain flange fitting.

BRIEF DESCRIPTION OF THE DRAWINGS

A better understanding of the invention can be obtained when the detailed description of exemplary embodiments set forth below is considered in conjunction with the attached drawings, which can be described as follows.

FIG. 3 is a side elevation in partial cross-section of a bathtub drain flange assembly installed in a bathtub drain shoe, according to the present invention.

FIG. 4 is a side elevation in partial cross-section of a bathtub drain flange assembly, according to the present invention.

FIG. 5 is a side elevation in cross-section of a threaded reducing bushing that can be part of bathtub drain flange kit, according to the present invention.

FIG. 6 is a side elevation in cross-section of a threaded reducing bushing that can be part of bathtub drain flange kit, according to the present invention.

FIG. 7 is a side elevation of a press-fit reducing bushing that can be part of bathtub drain flange kit, according to the present invention.

FIG. 8 is a top plan view of the reducing bushing of FIG. 7.

FIG. 9 is a cross-section of the reducing bushing of FIG. 8, as seen along the line 9-9.

FIG. 10 is a side elevation in partial cross-section of a bathtub drain flange assembly, according to the present invention, in which a drain stopper and strainer assembly is installed.

DETAILED DESCRIPTION OF THE EXEMPLARY EMBODIMENTS

Figures 1, 2:
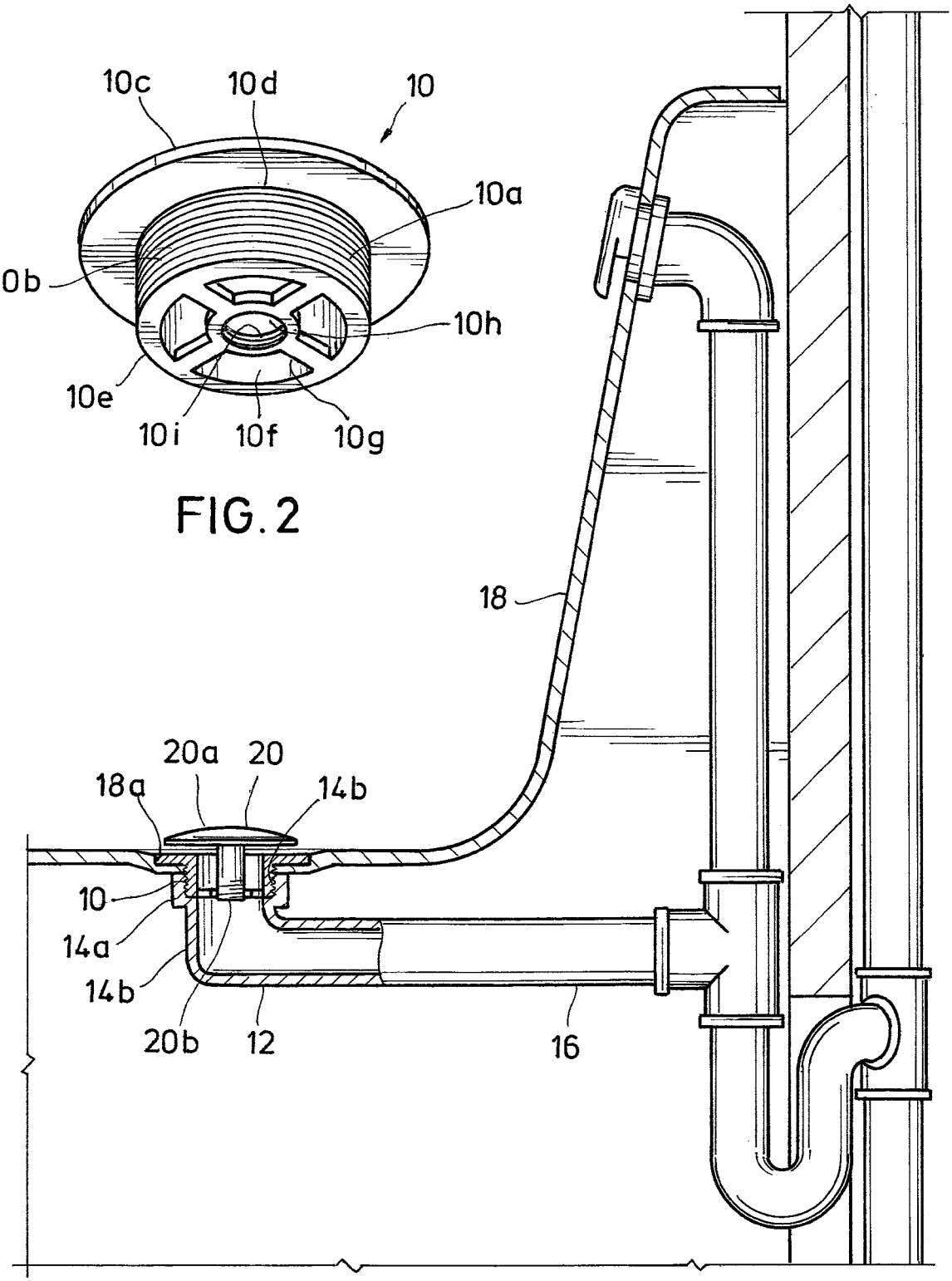
FIG. 1 is a side elevation in partial cross-section of a bathtub fitted with a bathtub drain system, according to the present invention.
FIG. 2 is a perspective view of a bathtub drain flange, according to the present invention.

FIG. 1 is a side elevation in partial cross-section of a bathtub drain flange fitting 10 in a threaded engagement with a bathtub drain shoe 12 that comprises a 90-degree elbow 14 formed integral with or attached to a drain pipe 16. A partial view in cross-section of a bathtub 18 shows a drain opening 18*a*. FIG. 2 is a perspective view of bathtub drain flange fitting 10, which comprises a tube or short piece of pipe 10*a* that has male threads 10*b* and a radially-extending flange 10*c* on an upper end 10*d* of the tube 10*a*. Tube 10*a* has an opposing lower end 10*e* and an inner surface 10*f* that defines a cylindrical drainage flow path. A support structure 10*g* at the lower end 10*e* is engaged with or fastened to the inner surface 10*f* or is formed integral with tube 10*a*. Support structure 10*g* has a threaded opening 10*h* that is defined by female threads 10*i*, which is in the center of the drainage flow path. Support structure 10*g* is illustrated as a pair of orthogonal crossbars, but can be any structure that provides the threaded opening 10*h* and that does not substantially block the drainage flow path. Further, a drain flange typically has a threaded opening such as threaded opening 10*h*; however, threads are not required for the present invention, which is discussed in some detail below.

The lower end 10*e* of the bathtub drain flange fitting 10 is passed through the drain opening 18*a* in the bathtub 18 and sealed against an upper surface of the bathtub 18 by plumber's putty or a gasket (not shown). Elbow 14 has a flanged upper end 14*a*, which has female threads 14*b*. A gasket or a sealing ring (not shown) is typically placed between the flanged upper end 14*a* of the elbow and the underside of the bathtub 18. The bathtub drain flange fitting 10 is screwed into the elbow 14. The male threads 10*b* on the tube 10*a* matingly engage the female threads 14*b* in the flanged upper end 14*a* of the elbow 14 of the bathtub drain shoe 12, thereby providing a drainage flow path for draining water out of the bathtub 18. A drain stopper 20 has a cap 20*a* on an upper end and male threads on an opposing lower end 20*b*. The threaded lower end 20*b* of the drain stopper 20 is received in threaded opening 10*h* in a threaded engagement with the support structure 10*g*. Related application Pub. No. 2017/0314245 A1 provides additional information on bathtub drain stoppers.

FIG. 3 is a side elevation in partial cross-section of a bathtub drain flange fitting 30 in a threaded engagement with the elbow 14 of the bathtub drain shoe 12 for sealing and providing a drainage flow path from a bathtub 28, which has a drain opening 28*a*. Drain flange fitting 30 comprises a tube or short piece of pipe 30*a* that has male threads 30*b* and a radially-extending flange 30*c* on an upper end 30*d* of the tube 30*a*. Tube 30*a* has an opposing lower end 30*e* and an inner surface 30*f* that defines a cylindrical drainage flow path. A support structure 30*g* at the lower end 30*e* is engaged with or fastened to the inner surface 30*f* or is formed integral with tube 30*a*. Support structure 30*g* has a threaded opening 30*h* that is defined by female threads 30*i*, which is in the center of the drainage flow path. Support structure 30*g* has a tubular extension 30*j* that extends downwardly from the underside of the support structure 30*g*. Tubular extension 30*j* has a central opening defined by female threads that is coaxial with and the same size as opening 30*h*, so the combined opening is referred to as opening 30*h*, and the combined threads are referred to as female threads 30*i*.

Support structure 30*g* can be any structure that provides the threaded opening 30*h* and that does not substantially block the drainage flow path. Support structure 30*g* preferably comprises a pair of crossbars that are orthogonal to one another and that have longitudinal axes that intersect at about the center of the drainage flow path. The support structure 30*g* includes a centralized ring, and the crossbars extend between an outer portion of the ring and the inner surface 30*f* of the tube 30*a*. Tubular extension 30*j* functions as a strengthening and reinforcement ring for providing a strong anchor point for attaching, directly or indirectly, a plumbing device such as a drain stopper to the support structure 30*g*. Tubular extension or reinforcement ring 30*j* extends longitudinally beyond and below the lower end 30*e* of tube 30*a*. The crossbars or an equivalent can be referred to as wall anchors that hold and support a ring, where preferably, the ring is thicker that the wall anchors. The wall anchors preferably have a lower surface that is coincident with the lower end 30*e* of the tube 30*a*, while the ring has an upper end that is coincident with the upper surface of the wall anchors and a lower end that extends below the lower surface of the wall anchors and below the lower end 30*e* of the tube 30*a*. The ring has a bore or opening 30*h* that is defined by the female threads 30*i*.

The threaded opening 30*h* has an inside diameter that is greater than the inside diameter of presently commercially available drain flanges. The purpose of this greater diameter is to be able to adapt the inside diameter of the threaded opening in the drain flange to the outside diameter of a drain stopper, strainer or drain cover that is to be received in the drain flange. A threaded tubular reducing bushing 40 is screwed into the threaded opening 30*h*, which reduces the size of the threaded opening in the drain flange to accommodate various stoppers, strainers and drain covers.

Plumbing devices, such as stoppers, strainers and drain covers, that screw into the threaded opening in a drain flange come in a number of different sizes, including ⅜, 5/16 and ¼ inch diameters and with 10-24 machine threads (size 10 with 24 threads per inch). Prior art drain flanges also have a threaded opening, which may have any one of these sizes or another size. It has been a problem to find a desired plumbing device of the right size for a previously-installed drain flange or even for a new drain flange if the desired plumbing device is from a manufacturer other than the one that made the drain flange. The present invention solves this problem by providing a drain flange with an oversized or larger-than-normal threaded opening, which can be reduced in size or diameter by a reducing bushing to provide a desired inside diameter of a threaded opening for a desired plumbing device, such as a drain stopper with or without a strainer, a stand-alone drain strainer or perforated drain cover or a decorative standoff drain cover such as one that hides the drain flange. The oversized or larger-than-normal threaded opening for the drain flange of the present invention may be ½, ⅝ or ¾ inch or any suitable or desirable size including metric sizes.

In FIG. 3, the reducing bushing 40 is screwed into the threaded opening 30*h* and has its own threaded bore 40*e*, which has a smaller inside diameter than the threaded opening 30*h*. A drain stopper 36 has a cap 36*a* and a threaded lower end 36*b*, which is screwed into the threaded bore 40*e* in the reducing bushing 40. The reducing bushing 40 adapts the size of the threaded opening 30*h* by providing the threaded bore 40*e*, which fits or matingly accommodates the threaded end 36*b* of the drain stopper 36.

FIG. 4 is a side elevation in partial cross-section of the bathtub drain flange fitting 30 of FIG. 3. FIG. 4 shows that the threaded reducing bushing 40 can be screwed into the bottom of the tubular extension 30*j* rather than into the top as was shown in FIG. 3. Placing the reducing bushing 40 on the underside of the drain flange 30 rather than on the topside provides additional flexibility and another option for accommodating a plumbing device. Some thought is required to ensure that as a plumbing device is threaded into the reducing bushing 40, the reducing bushing tightens into the threaded opening 30*h* rather than unscrewing from the threaded opening 30*h*. It may be desirable to use a reverse thread pattern.

FIG. 5 is a side elevation in cross-section of a threaded tubular reducing bushing 50, which comprises a hollow cylindrical tube that has an upper end 50*a*, an opposing lower end 50*b*, a central longitudinal bore 50*c*, a radially-extending flange 50*d* on the upper end 50*a*, female threads 50*e* that define the bore 50*c* in the flanged upper end 50*a* and male threads 50*f* on an outside surface of the tube 50*a* between an underside of the flange 50*d* and the lower end 50*b*. Reducer bushing 50 does not have threads defining the bore 50*c* between an underside of the flange 50*d* and the lower end 50*b*, although it could. The reducing bushing 50 has an inside diameter d1 of the bore 50*c* where the bore 50*c* is defined by female threads and an inside diameter d2 of the bore 50*c*, where the bore is defined by a smooth wall that does not have female threads. The threaded inside diameter d1 is smaller than the smooth-wall inside diameter d2. The radially-extending flange 50*d* can have a hexagonal head for receiving a socket wrench and can be referred to as a grip head.

FIG. 6 is a side elevation in cross-section of a threaded tubular reducing bushing 60, which is identical to the reducing bushing 50 in FIG. 5, except for having a threaded bore 60*e* that has a diameter d3 that is different from the diameter d1 of the threaded bore 50*e* in the reducing bushing 50 in FIG. 5. The diameters d1 and d3 are preferably two of the common diameters of plumbing devices that are used in bathtub drain flanges, such as 5/16 and 1/4 inch. Reducing bushing 40 in FIGS. 3 and 4 may have an inside diameter of its threaded bore 40*e* of 3/8 inch for accommodating the largest of the common sizes of male threaded ends on plumbing devices that get screwed into a drain flange in a bathtub. These sizes are, of course, provided for the purpose of illustration, and one should choose sizes that are appropriate for the anticipated applications. A bathtub drain flange kit preferably includes a plurality of reducing bushings that each have a male end of a size that fits properly in the threaded opening in the drain flange, where each reducing bushing has a different size threaded hole, and where each threaded hole corresponds to one of the standard sizes for bathtub plumbing devices that are typically received in a bathtub drain flange.

FIG. 7 is a side elevation of a press-fit reducing bushing 70. FIG. 8 is a top plan view of the reducing bushing 70. FIG. 9 is a cross-section of the reducing bushing 70 of FIG. 8, as seen along the line 9-9. Similar to the reducing bushing 50 in FIG. 5, reducing bushing 70 comprises a hollow cylindrical tube that has an upper end 70*a*, an opposing lower end 70*b*, a central longitudinal bore 70*c*, a radially extending flange 70*d* on the upper end 70*a* and female threads 70*e* that define the bore 70*c* in the flanged upper end 70*a*. Rather than having male threads to threadedly engage the threaded opening in a drain flange, the press-fit reducing bushing 70 has a plurality of cantilever springs 70*k* around the circumference of the tube. A cantilever spring is similar to a diving board for a swimming pool, where one end of the diving board is fixed in place and the other end is free to move up and down. The cantilever springs 70*k* have one end fixed to a ring or band 70*m* as shown in FIG. 9, and the other end of each spring 70*k* is not fixed and is free. The springs 70*k* are oriented longitudinally with respect to the longitudinal axis of the reducing bushing 70. A center portion of each spring 70*k* is curved radially outwardly. With reference to FIG. 9, end 70*b* of the reducing bushing 70 has a circumferential groove 70*n* in which the band 70*m* is received. The band 70*m* has a bead that fits in the groove 70*n* and a straight portion adjacent to the bead that lies against or abuts the outside surface of the tubular wall of the bushing 70. Various detent mechanisms can be used as an alternative to the cantilever springs 70*k*, which is particularly easy if the reducing bushing 70 is made of a plastic material that will deform and then regain its shape. For example, with reference to FIG. 5, the threads 50*f* can be replaced with a plurality of rings that are similar to threads, except parallel to one another and oriented orthogonal to the longitudinal axis of the reducing bushing. Threads spiral while the parallel rings do not. The rings can have a triangular cross-section and be arranged to easily deform as they are pushed into the threaded opening in the drain flange, but catch on the threads 30*i* to inhibit disengagement from the support structure 30*g*.

FIG. 10 is a side elevation in partial cross-section of the bathtub 28 and bathtub drain flange fitting 30 of FIG. 3. The drain flange 30 in FIG. 10 is the same as the drain flange 30 in FIG. 3. However, the press-fit reducing bushing 70 of FIGS. 7-9 is received in the threaded opening 30*h*. The press-fit reducing bushing 70 is not screwed into the threaded opening 30*h*; rather, bushing 70 is pressed into threaded opening 30*h*. The cantilever springs flatten or straighten out to some extent and press radially outwardly against the female threads that define the opening 30*h*, thereby providing friction between the reducing bushing 70 and the support structure 30*g* in the drain flange 30. It is this friction-based engagement that holds the reducing bushing 70 in the drain flange 30. This friction-based engagement is referred to as a press fit or an interference fit. The alternative detent mechanisms also rely on friction-based engagement. Since the engagement between the reducing bushing 70 and the drain flange 30 is based on the friction of a press fit or interference fit, it is not necessary for opening 30*h* in the support structure 30*g* to be threaded or to have female threads. Reducing bushing 70 can fit tightly and securely in an opening that is defined by a smooth or rough wall. A particularly good structure for the wall of the opening may be parallel rings of thread-like ridges that have a cross-section of a right triangle facing in a manner to make it easier to push a reducing bushing in than to pull the reducing bushing out of the opening 30*h* in the support structure 30*g*.

A drain stopper 80 has a cap 80*a* and a male-threaded lower end 80*b*, which is in a threaded engagement with the female threads 70*e* that define the bore 70*c* in the reducing bushing 70. Drain stopper 80 is engaged with the reducing bushing 70 by threads, but the reducing bushing 70 is engaged with the drain flange 30 by friction between the plurality of cantilever springs 70*k* and the female threads 30*i* that define the threaded opening 30*h* in the drain flange 30. Drain stopper 80 has an elongate open-close mechanism 80*c* and a seal 80*d*. A strainer 82 surrounds the open-close mechanism 80*c* and is in the drainage flow path so that any hair, debris or object tends to be caught and held in or on the strainer 82. Since the drain stopper 80 is in a press-fit or friction engagement with the drain flange 30 through the reducing bushing 70, drain stopper 70 can be simply pulled out of the drain flange 30 to clean the strainer 82.

As has been stated above, there has often been a mismatch between the inside diameter of a threaded opening in a drain flange fitting in a bathtub drain system and the outside diameter of a plumbing device that one wishes to place in the drain flange. The present invention provides a drain flange that has an oversized or larger-than-normal threaded opening and at least one reducing bushing that fits properly in the threaded opening and fastens or attaches the reducing bushing to the drain flange, where the reducing bushing provides one of a number of standard sizes for a threaded opening for receiving and holding a plumbing device such as a drain stopper. In addition to this bathtub drain flange assembly, which includes at least one reducing bushing, the present invention provides a bathtub drain flange kit that includes at least two reducing bushings and preferably a reducing bushing for each of the several standard sizes for plumbing devices that are received and held in a bathtub drain flange. The reducing bushings function as adapters for connecting a plumbing device to a drain flange where otherwise there is a mismatch between the size of the threaded opening in the drain flange and the size of a threaded end on the plumbing device that is meant to connect to the drain flange. The bathtub drain flange kit preferably includes a reducing bushing for each of the standard 10-24 machine thread and ⅜, 5/16 and ¼ inch diameter male-threaded ends of typical bathtub plumbing devices. While a reducing bushing is typically engaged with a drain flange using a threaded engagement, threads are not the only means for engagement. The support structure in the drain flange can have an opening that is not threaded, and the reducing bushing can engage the drain flange using a press fit or an interference fit.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A bathtub drain flange assembly comprising:

a bathtub drain flange comprising:

a tube having upper and lower ends and inner and outer surfaces;

a flange extending radially outwardly from the upper end of the tube, wherein the flange is designed and sized to surround a drain opening in a bathtub such that water in the bathtub will drain into the flange and then into the tube, wherein the flange has an upper surface designed to be in the bathtub, and wherein the inner surface of the tube defines a cylindrical drainage flow path having a constant diameter between the upper surface of the flange and the lower end of the tube;

male threads on the outer surface of the tube; and a support structure in the lower end of the tube attached to or formed integral with the inner surface, wherein the support structure defines an opening; and a reducing bushing received in the opening for reducing the inside diameter of the opening in the support structure, wherein the reducing bushing is detachably attached to the support structure, wherein the reducing bushing has an inside surface and an outside surface, wherein the outside surface is engaged with the support structure, and wherein the inside surface defines a longitudinal bore or bore hole for receiving a plumbing device in the bore or bore hole.

2. The bathtub drain flange assembly of claim 1, wherein the opening in the support structure is defined by female threads, wherein the outside surface of the reducing bushing has male threads, and wherein the reducing bushing is threadedly engaged with the support structure.

3. The bathtub drain flange assembly of claim 1, wherein the inside surface of the reducing bushing has female threads that define a portion of the longitudinal bore or bore hole, and wherein the reducing bushing has opposing first and second ends and a grip head on the first end, wherein either the grip head or the second end may be closer to the flange.

4. The bathtub drain flange assembly of claim 1, wherein the support structure further includes a tubular ring that further defines the opening, wherein the tubular ring extends longitudinally away from the support structure, wherein the inside surface of the reducing bushing has female threads that define a portion of the longitudinal bore or bore hole, wherein the outside surface of the reducing bushing has male threads, and wherein the tubular ring has female threads for receiving the reducing bushing.

5. A bathtub drain flange kit comprising:

the bathtub drain flange assembly of claim 4; and a reducer bushing to replace the reducing bushing, wherein the reducer bushing has an inside surface that defines an aperture, wherein the bore or borehole of the reducing bushing and the aperture in the reducer bushing each have a diameter, and wherein the diameters are different.

6. A bathtub drain flange kit comprising:

the bathtub drain flange assembly of claim 1; and a reducer bushing to replace the reducing bushing, wherein the reducer bushing has an inside surface that defines an aperture, wherein the bore or borehole of the reducing bushing and the aperture in the reducer bushing each have a diameter, and wherein the diameters are different.

7. A bathtub drain flange kit, comprising:

the bathtub drain flange assembly of claim 1; and a drain stopper having opposing ends, a cap and a seal on one end for holding water in a bathtub and means on the other end for engaging the reducing bushing for anchoring the drain stopper to the support structure.

8. The bathtub drain flange kit of claim 7, wherein the means for engaging the support structure is a press fit or an interference fit.

9. The bathtub drain flange kit of claim 8, wherein the drain stopper has an open-close mechanism, further comprising a strainer surrounding the open-close mechanism.

10. The bathtub drain flange kit of claim 7, wherein the support structure has a lower surface that is coincident with a lowermost portion of the lower end of the tube, wherein the drain stopper has an open-close mechanism; further comprising a strainer surrounding the open-close mechanism.

11. The bathtub drain flange kit of claim 10, wherein the strainer is configured to catch hair and debris on an outside surface of the strainer.

12. The bathtub drain flange kit of claim 7, further comprising a reducer bushing to replace the reducing bushing, wherein the reducer bushing has an inside surface that defines an aperture, wherein the bore or borehole of the reducing bushing and the aperture in the reducer bushing each have a diameter, and wherein the diameters are different.

13. A bathtub drain flange assembly, comprising:

a bathtub drain flange, comprising:

a tube having upper and lower ends and inner and outer surfaces;

a flange extending radially outwardly from the upper end;

male threads on the outer surface; and a support structure in the lower end attached to or formed integral with the inner surface, wherein the support structure has a wall that defines an opening; and a reducing bushing received in the opening, wherein the reducing bushing has an inside surface and an outside surface, wherein the outside surface is engaged with the support structure, and wherein the inside surface defines a longitudinal bore or bore hole for receiving a plumbing device, wherein the outside surface of the reducing bushing has a plurality of cantilever springs that become compressed while inside the opening, wherein the springs push outwardly against the wall that defines the opening, thereby engaging the reducing bushing with the support structure.

14. A bathtub drain flange assembly comprising:

a bathtub drain flange comprising:

a hollow tube having upper and lower ends and inner and outer surfaces;

a flange extending radially outwardly from the upper end of the tube, wherein the flange is designed and sized to surround a drain opening in a bathtub and to receive a seal between the bathtub and the flange for providing a sealed flow path from the bathtub into the tube, and wherein the flange has an uppermost surface designed to be inside the bathtub, wherein the inner surface of the tube defines a cylindrical drainage flow path having a constant diameter between the uppermost surface of the flange and the lower end of the tube;

male threads on the outer surface of the tube; and a support structure in the lower end attached to or formed integral with the inner surface of the tube, wherein the support structure has a surface that is coincident with a lowermost portion of the lower end of the tube, wherein the support structure defines an opening having female threads; and a reducing bushing received in the opening and removably engaged with the support structure, wherein the reducing bushing has a length, opposing ends, a bore through the length, female threads that define at least a portion of the bore for receiving a plumbing device, an outside surface and a grip head on one end that extends radially outwardly.

15. The bathtub drain flange assembly of claim 14, wherein the outside surface of the reducing bushing has male threads, wherein the support structure includes a tubular ring that defines the opening, wherein the reducing bushing is threadedly engaged with the tubular ring, and wherein the tubular ring extends longitudinally beyond the lower end of the hollow tube.

16. The bathtub drain flange assembly of claim 14, wherein the outside surface of the reducing bushing has male threads, and wherein the reducing bushing is threadedly engaged with the support structure.

17. The bathtub drain flange assembly of claim 14, wherein the outside surface of the reducing bushing does not have male threads, and wherein the reducing bushing is engaged with the support structure by a press fit or interference fit in which the reducing bushing is secured within the opening by a non-threaded, friction-based engagement.

18. The bathtub drain flange assembly of claim 14, wherein the outside surface of the reducing bushing has a plurality of cantilever springs that become compressed while inside the opening, and wherein the springs push outwardly against the female threads that define the opening, thereby engaging the reducing bushing with the support structure.

19. The bathtub drain flange assembly of claim 14, wherein the support structure includes a pair of orthogonal crossbars that extend between the tubular ring and the inner surface of the tube.

20. The bathtub drain flange assembly of claim 19, wherein the reducing bushing is threadedly engaged with the support structure.

21. The bathtub drain flange assembly of claim 14, wherein the support structure and the inner surface of the tube define an internal space, and wherein the grip head is in the internal space.

22. The bathtub drain flange assembly of claim 14, wherein the support structure and the inner surface of the tube define an internal space, and wherein the grip head is not in the internal space.

23. A bathtub drain flange kit comprising:

a bathtub drain flange comprising:

a tube having upper and lower ends and inner and outer surfaces;

a flange extending radially outwardly from the upper end, wherein the flange has an uppermost surface designed to be inside a bathtub;

male threads on the outer surface of the tube, wherein the tube is cylindrical and has a constant inside diameter from the uppermost surface of the flange to the lower end of the tube; and a support structure in the lower end attached to or formed integral with the inner surface, wherein the support structure has a wall that defines an opening; and first and second reducing bushings, wherein each reducing bushing has a longitudinal bore defined by threads, wherein each longitudinal bore has a diameter, wherein the diameter of the first reducing bushing is different from the diameter of the second reducing bushing, wherein each of the first and second reducing bushings are sized and adapted to be received in the opening in the support structure so that the first and second reducing bushings are interchangeable.

24. The bathtub drain flange kit of claim 23, wherein the opening in the support structure is defined by threads, and wherein each reducing bushing has threads on an outside surface for a threaded engagement with the support structure.

25. The bathtub drain flange kit of claim 23, wherein the first and second reducing bushings are adapted to be received in the opening in the support structure in a press fit or an interference fit.

26. The bathtub drain flange kit of claim 23, further comprising a drain stopper that has an open-close mechanism that has opposing ends, a cap and a seal on one end for holding water in a bathtub and means on the other end for engaging the first or second reducing bushing for anchoring the drain stopper to the support structure.

27. The bathtub drain flange kit of claim 26, further comprising a strainer, wherein the drain stopper is designed to engage the support structure in a manner that allows the drain stopper to be simply pulled out of the tube to clean the strainer and then pushed back into the tube.

* * * * *